US008732877B2

(12) United States Patent
Ramp

(10) Patent No.: US 8,732,877 B2
(45) Date of Patent: May 27, 2014

(54) SYSTEMS AND METHODS FOR BODY SUPPORT

(76) Inventor: Kathleen Ramp, Morgan Hill, CA (US)

( * ) Notice: Subject to any disclaimer, the term of this patent is extended or adjusted under 35 U.S.C. 154(b) by 182 days.

(21) Appl. No.: 13/088,308

(22) Filed: Apr. 15, 2011

(65) Prior Publication Data

US 2011/0252568 A1 Oct. 20, 2011

Related U.S. Application Data

(60) Provisional application No. 61/325,192, filed on Apr. 16, 2010.

(51) Int. Cl.
*A47C 20/00* (2006.01)

(52) U.S. Cl.
USPC ..... 5/632; 5/655.3; 5/636; 5/690; 5/640

(58) Field of Classification Search
USPC ..... 5/655.3, 640, 636, 658, 655.9, 657, 5/655.5, 632, 652, 644
See application file for complete search history.

(56) References Cited

U.S. PATENT DOCUMENTS

| | | | |
|---|---|---|---|
| 1,537,414 | A | 5/1925 | Darling |
| 1,542,674 | A | 6/1925 | Darling |
| 2,149,140 | A | 2/1939 | R. Gonzales-Rincones |
| 2,933,738 | A | 4/1960 | Whelan |
| 3,828,377 | A | 8/1974 | Fary, Sr. |
| 4,171,549 | A | 10/1979 | Morrell |
| 4,190,918 | A | 3/1980 | Harvell |
| 4,780,921 | A | 11/1988 | Lahn et al. |
| 4,802,249 | A | 2/1989 | Bills |
| 4,837,879 | A | 6/1989 | Parnham |
| 4,850,067 | A | 7/1989 | Latorre |
| 4,901,384 | A | 2/1990 | Eary |
| 4,951,334 | A | 8/1990 | Maier |
| 5,054,142 | A | 10/1991 | Owens |
| 5,103,516 | A | 4/1992 | Stevens |
| 5,163,194 | A | 11/1992 | Dixon |
| 5,279,310 | A | 1/1994 | Hsien |
| 5,360,017 | A | 11/1994 | Austin |
| 5,528,784 | A | 6/1996 | Painter |
| 5,566,682 | A | 10/1996 | Yavitz |

(Continued)

FOREIGN PATENT DOCUMENTS

WO WO 2009/103109 A1 8/2009

OTHER PUBLICATIONS

International Preliminary Report on Patentability PCT/US2011/032791—Oct. 26, 2012.

(Continued)

*Primary Examiner* — Brittany Wilson
(74) *Attorney, Agent, or Firm* — Steven R. Vosen

(57) ABSTRACT

A body support system for relieving contact pressure on a joint in a body, according to various aspects of the present invention, may be configured to elevate a chest portion of the body with a chest support that may be configured to form a taper disposed between a top portion and a bottom portion such that the weight of the body compresses the chest support, which may result in the chest support assuming a substantially inverted arc shape. The compressed edges of the arc may be occupied by the joint. The chest support may further be adjustable for positioning substantially between a collarbone portion of the body and a xiphoid process portion of the body when the body is in a side rest position.

41 Claims, 13 Drawing Sheets

(56) References Cited

U.S. PATENT DOCUMENTS

| | | | |
|---|---|---|---|
| 5,632,050 | A | 5/1997 | Zajas et al. |
| 5,642,543 | A | 7/1997 | Huntley |
| 6,038,722 | A | 3/2000 | Giori et al. |
| 6,067,677 | A | 5/2000 | Reen et al. |
| 6,795,990 | B1 | 9/2004 | Hutchinson |
| 7,020,918 | B1 | 4/2006 | Tinsley |
| 7,516,504 | B2 | 4/2009 | Guez |
| 7,536,740 | B1 | 5/2009 | Swartz |
| 7,536,741 | B1 | 5/2009 | Schultz |
| 7,634,829 | B1 | 12/2009 | La Bar |
| 7,661,163 | B1 | 2/2010 | Gallaher |
| 7,698,766 | B2 | 4/2010 | Schultz |
| 7,849,540 | B2 | 12/2010 | Hill |
| 2005/0060806 | A1 | 3/2005 | Wilkinson |
| 2005/0138733 | A1 | 6/2005 | Riesberg |
| 2005/0144725 | A1 | 7/2005 | Guarino |
| 2005/0150048 | A1 | 7/2005 | Hamilton |
| 2007/0163048 | A1 | 7/2007 | Kimball |
| 2008/0022459 | A1* | 1/2008 | Cho ..... 5/636 |
| 2008/0028529 | A1 | 2/2008 | Abell |
| 2008/0134437 | A1 | 6/2008 | Small |
| 2010/0186171 | A1 | 7/2010 | Schultz |

OTHER PUBLICATIONS

International Search Report and Written Opinion PCT/US2011/032791—Nov. 23, 2011.

* cited by examiner

SYSTEMS AND METHODS FOR BODY SUPPORT

CROSS REFERENCE TO RELATED APPLICATION

This application claims the benefit of the U.S. Provisional Patent Application No. 61/325,192, filed Apr. 16, 2010, and incorporates the disclosure of the application by reference.

BACKGROUND OF INVENTION

Injuries or stress on any joint in the body can create difficulties for a person to perform a variety of daily activities such as work, play, sleep, and exercise. Prolonged stress or an acute injury to a joint may require medical intervention that may be costly, painful, and prolonged by additional stress to the joint during healing such as from daily activity requiring use of the joint and pressure from an improper sleep position.

The human shoulder has the greatest range of motion of any joint in the body. The shoulder joint comprises four muscles and their associated tendons that are referred to as the rotator cuff, which is surrounded by a bursa sac for accommodating movement of the tendons. Injury or trauma to the shoulder joint may comprise bursitis, tendonitis, arthritis, rotator cuff tears, calcification of the joint, subluxation (instability of the joint due to stretched or torn ligaments), dislocation, and/or actual breakage of the humerus, scapula, and/or clavicle bones.

Treatment of shoulder joint injuries may comprise non-invasive techniques such as physical therapy and/or pain relief and anti-inflammatory medications. However, invasive techniques including shoulder replacement (shoulder arthroplasty), cortisone injections, and surgical repair of rotator cuff tears are also used in cases where a poor outcome from nonsurgical treatment is indicated, such as a long duration of symptoms and larger rotator cuff tears.

Recovery from a shoulder injury requires a person to endure pain, tenderness, swelling, and stiffness of the shoulder joint. The person may also experience numbness or tingling of the arm or hand where nerves have been affected in the shoulder area. Therapy to rehabilitate an injured shoulder joint may require limited or complete cessation of use of the affected arm, followed by progressive range-of-motion exercises and strength training.

The process of recovering from a shoulder joint injury may cause prolonged sleep disturbances. Traditional mattresses, pillows, recliners, and other methods and tools used for sleep may add pressure to an injured shoulder or cause stress or soreness to the neck, back, and opposite shoulder where certain sleep positions may be favored to help reduce pressure on the injured shoulder. For example, sleeping exclusively on the opposite shoulder may result in a sore arm. Further, sleeping in a supine position on the back may cause flattening of the lumbar curve resulting in misalignment of one or more lumbar vertebrae and/or pain where the shoulder is in contact with the bedding surface as the body sinks into the bed.

Side sleeping using the traditional sleep methods and/or tools may aggravate several medical conditions in addition to a damaged shoulder joint. For example, side sleeping may cause pain for people with asymmetrical muscular tonus in the neck and/or shoulder, a subluxated head of the humerus, and/or arthritis in the shoulder and/or cervical thoracic spine. Further, sleeping on the side of the body without adequate support for the head and chest may compress the shoulder into the trunk, causing muscular and ligamental tension in the shoulder girdle and neck possibly, and may inhibit normal respiration by constricting the ribs.

Sleep devices to assist with shoulder or neck discomfort generally comprise the strategic placement of traditional bed pillows under the body to relieve pressure and sleep systems that reduce pressure on the shoulder or other part of the body. These sleep devices have numerous problems with providing consistent comfort for the sleeper.

SUMMARY OF THE INVENTION

A body support system for relieving contact pressure on a joint in a body, according to various aspects of the present invention, may be configured to elevate a chest portion of the body with a chest support that may be configured to form a taper disposed between a top portion and a bottom portion such that the weight of the body compresses the chest support, which may result in the chest support assuming a substantially inverted arc shape. The compressed edges of the arc may be occupied by the joint. The chest support may further be adjustable for positioning substantially between a collarbone portion of the body and a xiphoid process portion of the body when the body is in a side rest position.

BRIEF DESCRIPTION OF THE DRAWINGS

A more complete understanding of the present invention may be derived by referring to the detailed description when considered in connection with the following illustrative figures. In the following figures, like reference numbers refer to similar elements and steps throughout the figures.

Figure 1:
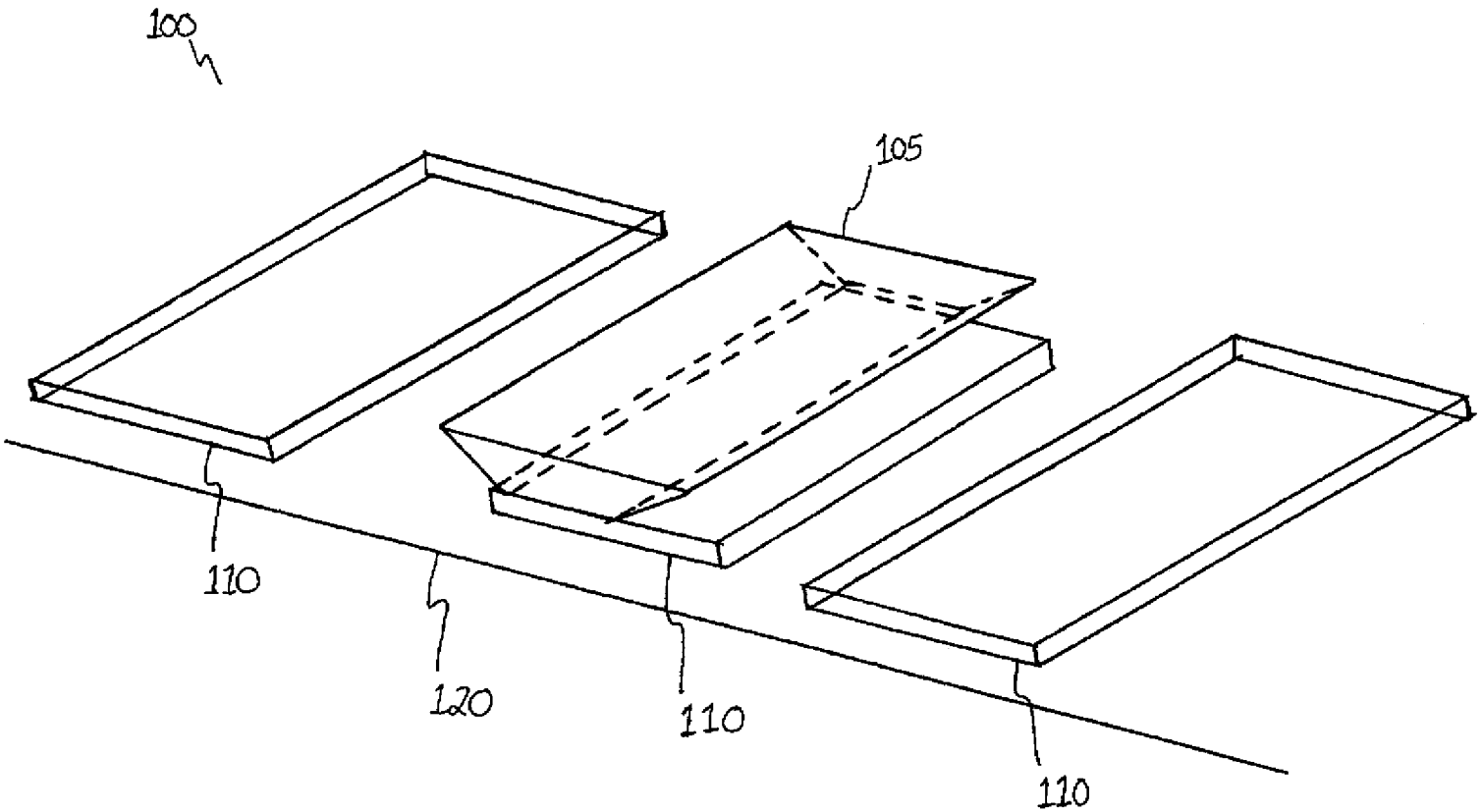
FIG. 1 representatively illustrates an exemplary embodiment of the body support system.

Elements and steps in the figures are illustrated for simplicity and clarity and have not necessarily been rendered according to any particular sequence or scale. For example, steps that may be performed concurrently or in different order are illustrated in the figures to help to improve understanding of embodiments of the present invention.

DETAILED DESCRIPTION OF EXEMPLARY EMBODIMENTS

The present invention may be described in terms of functional block components and various processing steps. Such functional blocks may be realized by any number of components configured to perform the specified functions and achieve the various results. For example, the present invention may employ various process steps, apparatus, systems, methods, etc. In addition, the present invention may be practiced in conjunction with any number of systems and methods for providing support and/or comfort to a joint in the body, and the system described is merely one exemplary application for the invention. Further, the present invention may employ any number of conventional techniques for treating, medicating, rehabilitating, strengthening, supporting, lifting, reducing pressure, and/or providing therapy to a joint in the body.

The particular implementations shown and described are illustrative of the invention and its best mode and are not intended to otherwise limit the scope of the present invention in any way. Indeed, for the sake of brevity, conventional manufacturing, connection, preparation, and other functional aspects of the system may not be described in detail. Furthermore, the connecting lines shown in the various figures are intended to represent exemplary functional relationships and/or steps between the various elements. Many alternative or additional functional relationships or physical connections may be present in a practical system.

Various representative implementations of the present invention may be applied to any system for providing support to a user's body. Certain representative implementations may include, for example, providing any suitable system or method for providing support to an injured and/or stressed joint in the body to allow the user to sleep without discomfort. In one embodiment, a body support system may comprise a chest support that may elevate a torso to relieve pressure on an injured shoulder when the user sleeps on the side of the injured shoulder. In another embodiment, the body support system may also comprise a lift cushion to elevate one or more of the user's head, chest, and hip to accommodate the height of the chest support for proper neck and spinal alignment and optimal unobstructed breathing rhythm. Certain representative implementations may also include integrating and/or connecting the chest support to the lift cushion to fix the position of the chest support relative to the lift cushion where the lift cushion is located in a stacked position under the chest support and/or adjacent to the chest support under the user's head and/or hip.

Figure 6:
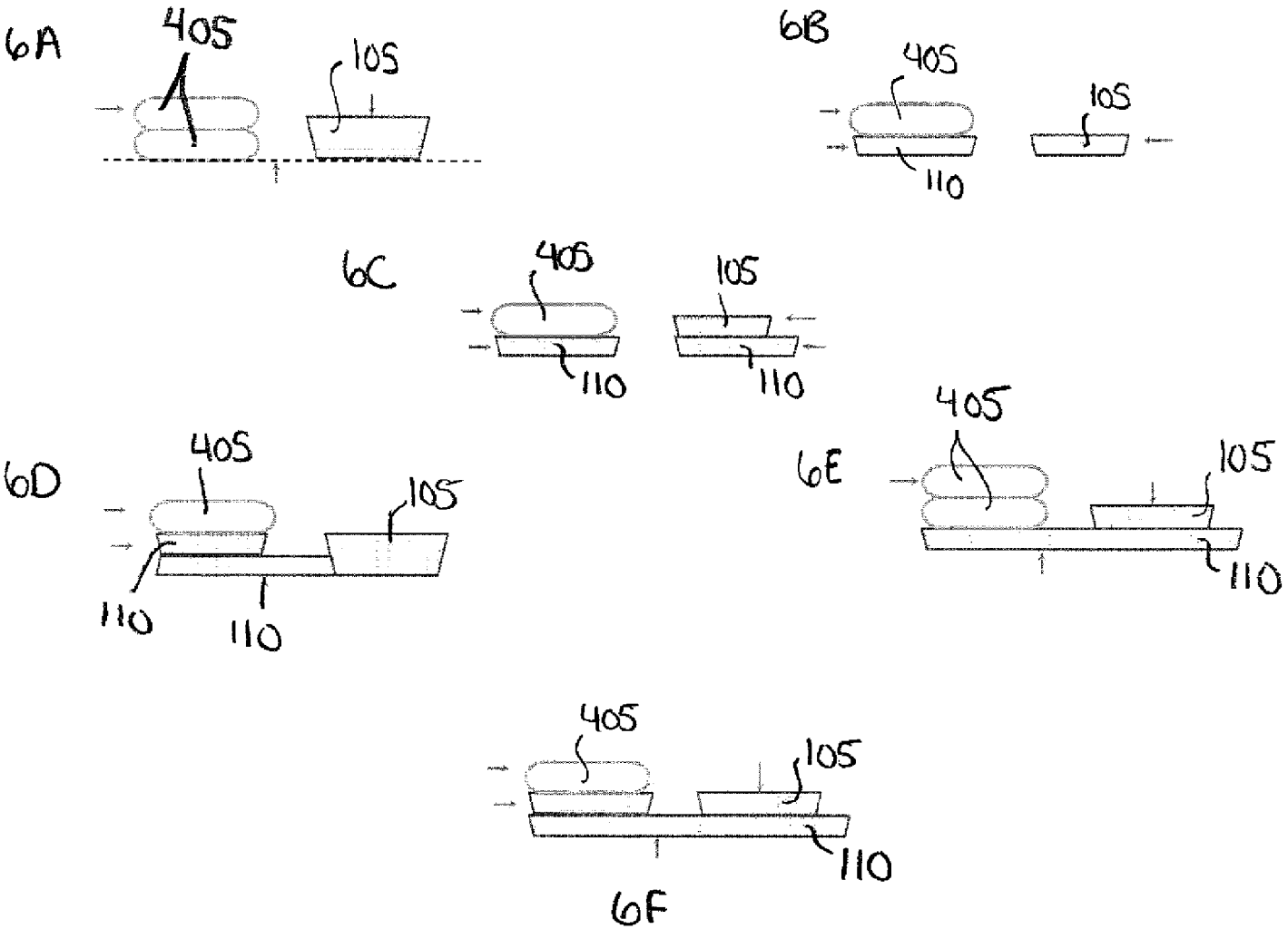
FIGS. 6A-F representatively illustrate various embodiments and wedge shaped configurations of the body support system.

Referring now to FIG. 1, systems and methods for providing joint support according to various aspects of the present invention may be representatively illustrated by body support system 100. The body support system 100 may comprise at least one of a chest support 105 and a lift cushion 110. The body support system 100 may comprise any number of chest supports 105 and or lift cushions 110 arranged in any configuration such as adjacent to one another and/or stacked on top of one another. Various, exemplary configurations of the body support system 100 are illustrated in FIG. 6, as discussed below. In various embodiments, the body support system 100 may be used on top of a surface 120. The surface 120 may comprise any suitable surface for a user such as a person and/or other animal to lie horizontally, such as for rest and/or sleep. For example, the surface 120 may comprise a mattress, a pad, a floor, and/or a piece of furniture such as a couch or any other substantially flat surface that can sustain the weight of the user.

Figure 2:
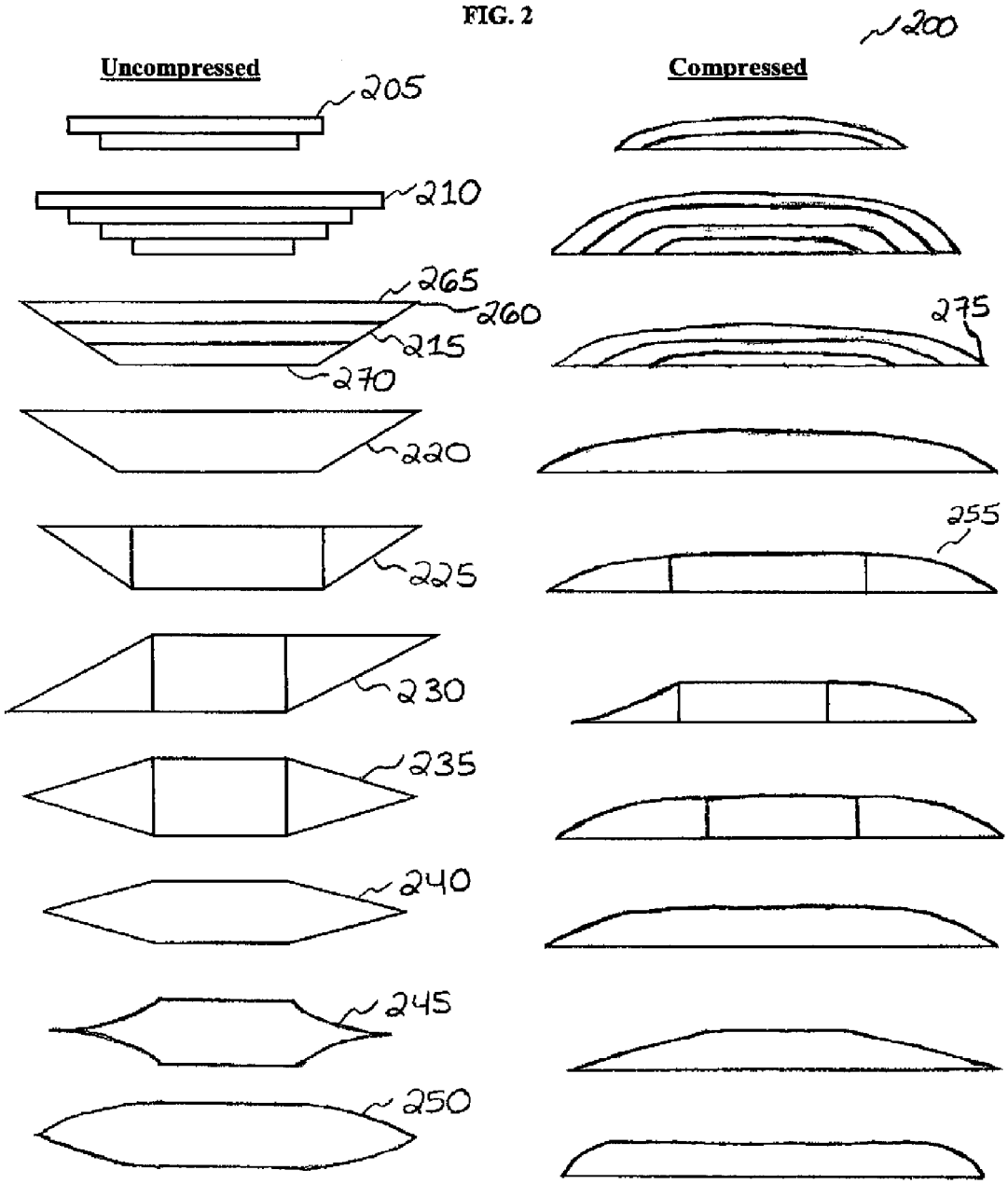
FIG. 2, representatively illustrates cross sectional views of various exemplary embodiments of the chest support.

Referring to FIGS. 1 and 2, the chest support 105 may comprise any suitable structure and/or device to support the user's chest. In various embodiments according to the present invention, the user may rest their torso and/or chest portion of their body, which may or may not include the shoulder, on the chest support 105. In one embodiment, the chest support 105 may elevate the chest and/or the torso of the user such that the user's shoulder is lifted away from the surface 120, relieving pressure applied to the user's shoulder by the surface 120. In another embodiment, the chest support 105 may elevate the chest and/or the torso of the user such that the user's hip is lifted away from the surface 120, relieving pressure applied to the user's hip by the surface 120.

In one embodiment, the chest support 105 may be elevated and/or supported by the lift cushion 110. For example, the lift cushion 110 may be inserted between the chest support 105 and the surface 120. The lift cushion 110 may elevate the chest support 105 to further reduce pressure on the shoulder and/or the hip to improve the user's comfort while sleeping. In one embodiment, the lift cushion 110 may be coupled to the underside of the chest support 105. In various embodiments of the present invention, the lift cushion 110 may be used to elevate any one or more of a head portion, a chest portion, and a hip portion of the body.

The chest support 105 may comprise any suitable shape that may provide reduced shoulder pressure to the user. Further, the shape of the chest support 105 may be formed with any suitable numbers, layers, and/or pieces of component material. For example, the shape of the chest support may comprise a taper toward the edges such that the width of the edges gradually from a central portion of the chest support 105 to an edge. Referring to FIG. 2, in various embodiments according to the present invention, a cross sectional views of the chest support 105 may comprise various "tapered" shapes 200 such that a cross section of the center of the chest support 105 gradually or sharply thins toward the edges of the chest support 105. In one embodiment, a straight edged chest support 205, 210 may be formed with one or more layers of a component material wherein a top layer exceeds the length of the edges of a bottom layer, thus creating a step-like tapering from the center of the chest lift pillow 205 and 210 to the edges. In another embodiment, an inverted trapezoidal shaped chest support 215, 220, 225 may be formed with one or more layers of the component material that is configured to be wider at a top portion than a bottom portion. In yet another embodiment, a chest support 230, 235, 240 may comprise one or more layers of the component material that is configured to have a first side with an inverted slope relative to a second side or a slope extending from the edges of the top portion of the chest support and the bottom of the chest support to form a hexagonal shape. Additionally, the taper a chest support 245, 250 may comprise a concave or convex edge shape along a central plane.

In an exemplary embodiment of the present invention, the chest support 105 may be configured to assume a substantially inverted arc shape 255 when compressed by the weight of the body. For example, the chest portion of the user may rest on top Of the chest support 105 applying pressure to the top portion of the chest support 105, causing the tapered edges to slope downward toward the surface 120 to form a slope or depression at an edge to be occupied by a shoulder portion of the body. In an exemplary embodiment, the chest support 105 may form a taper such that the top 265 may be longer than the bottom 270, wherein an edge 260 is deflected downward toward a surface 120 to a position 275. The juncture between the tapered edge and the center of the chest support 105 may be smooth and/or continuous such that the user feels a seamless transition of the firm support of the chest support 105 and the tapered edge, providing comfort to the shoulder. The substantially inverted arc shape 255 illustrates that the chest support 105 may retain the most thickness toward the middle portion upon compression to support the chest portion of the body and may taper at the edges to reduce pressure on the shoulder from contact with the surface 120.

Figure 3:
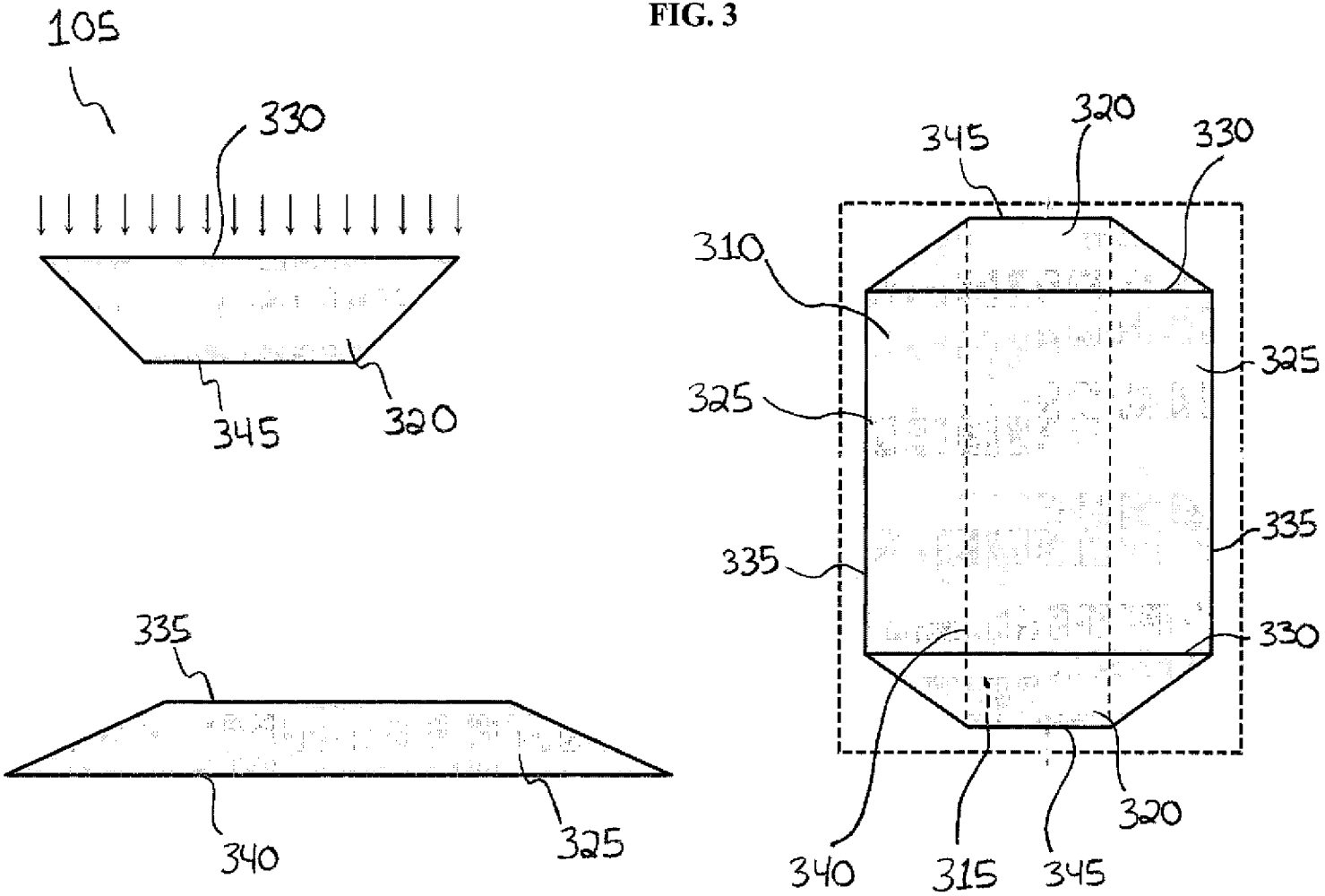
FIG. 3 representatively illustrates an exemplary embodiment of the chest support.

As illustrated in FIG. 3, an exemplary embodiment of the present invention, the chest support 105 may comprise a top 310, a bottom 315, a pair of ends 320, and a pair of sides 325. The top 310 may comprise a pair of end edges 330 and a pair of side edges 335. The bottom 315 may comprise a pair of end edges 340 and a pair of side edges 345. The chest support 105 may comprise an irregular trapezoidal shape with oppositely directed tapers at the pair of ends 320 and the pair of sides 325. The pair of ends 320 may be configured in an inverted trapezoidal shape that may be tipped inward at the top 310 of the chest support 105, such that the user's body weight compresses the chest support 105, deflecting the pair of side edges 335 of the top 310 downward, while the shape of the central section remaining substantially intact, as is described with respect to FIG. 2 above. In one embodiment, the pair of ends 320 may taper inward from the top end edges 330 to the bottom end edges 340. The pair of sides 125 may taper inward from the top side edges 335 to the bottom side edges 345. In an alternative embodiment, the pair of ends 320 may taper outward from the top end edges 330 to the bottom end edges 340 and the pair of sides 325 may taper inward from the top side edges 335 to the bottom side edges 345. These compression model may result in a transition from the chest support 105 supporting the torso of the use and providing a depression at the shoulder junction. The pair of sides 325 may comprise a trapezoidal shape with tapered edges at the bottom 315 to provide a smooth surface when resting the torso on the chest support 105, avoiding formation of a restrained section near the corners where the pair of ends 320 meet the pair of sides 325.

Figure 4:
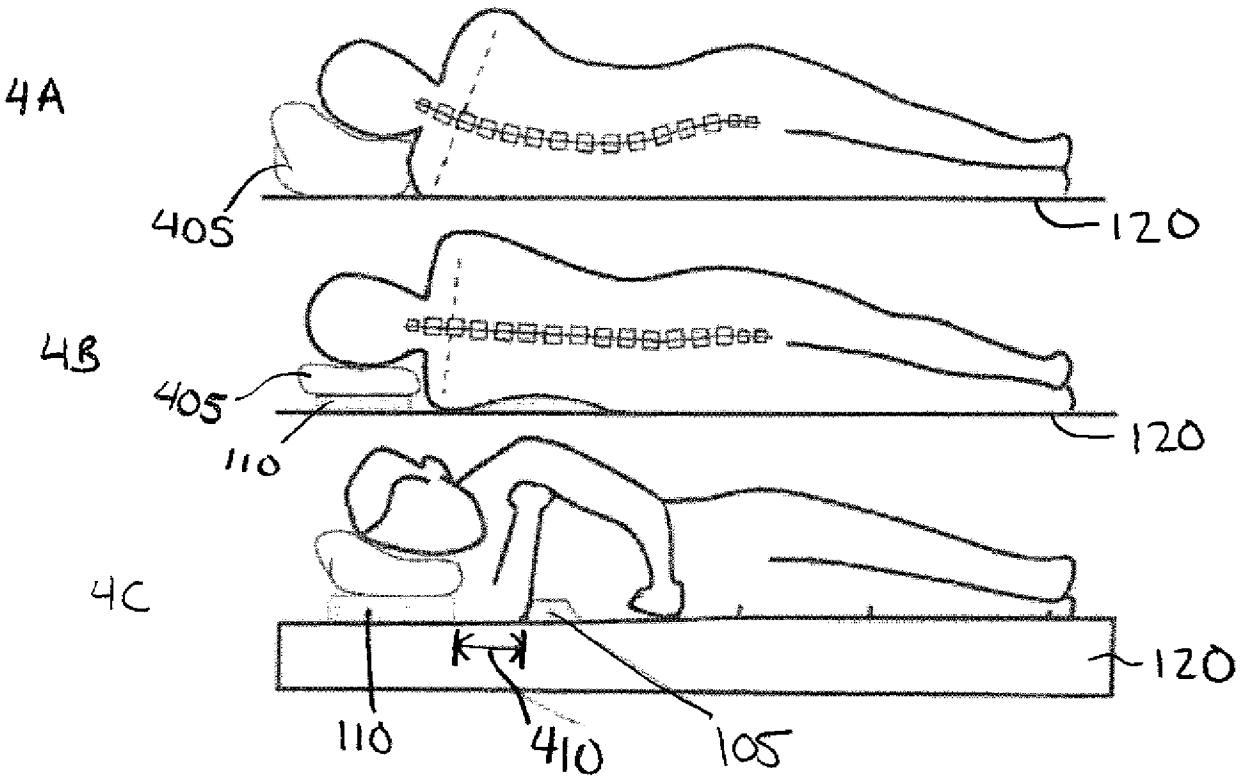
FIG. 4 representatively illustrates the spinal alignment resulting from use of an exemplary embodiment of the body support system FIG. 5 representatively illustrates an exemplary embodiment of the lift cushion.

Referring to FIGS. 1 and 4, the lift cushion 110 may comprise any suitable structure and/or device to support one or more of a head portion, a chest portion, and a hip portion of the body. FIG. 4A illustrates a conventional orientation of a traditional bed pillow 405 placed under a user's head. In an exemplary embodiment, as shown in FIGS. 4B and 4C, the lift cushion 110 may be placed between the user's traditional bed pillow 405 and the surface 120 to elevate the user's head to accommodate the height added to the chest by the chest support 105. In one embodiment, the lift cushion 110 may elevate the head portion to the user's normal height used for sleeping and/or to a height to provide a substantially aligned spinal portion of the body 415 (shown in FIG. 4B). In another embodiment, the lift cushion 110 may be the user's only bed pillow for use under the head portion of the body or the user may place the lift cushion 110 over their traditional bed pillow (not shown). In an exemplary embodiment of the present invention, the lift cushion 110 may comprise any length that may support one or more of the head, chest and hip in a single piece. In one embodiment, the lift cushion 110 may be configured to add elevation to the chest support 105 without interfering with lower diaphragm expansion during breathing.

In one embodiment, according to various aspects of the present invention, the lift cushion 110 disposed under at least one of the head portion and the chest portion of the body may shift or "tip" the user's body weight onto their hip. In various embodiments, the lift cushion 110 may elevate the hip to the user's normal height used for sleeping to provide suitable spinal alignment and/or to re-distribute the user's body weight more evenly to the rest of the body, relieving pressure on the hip. In some embodiments, the lift cushion 110 may extend between the user's hip and knee.

Figure 5:
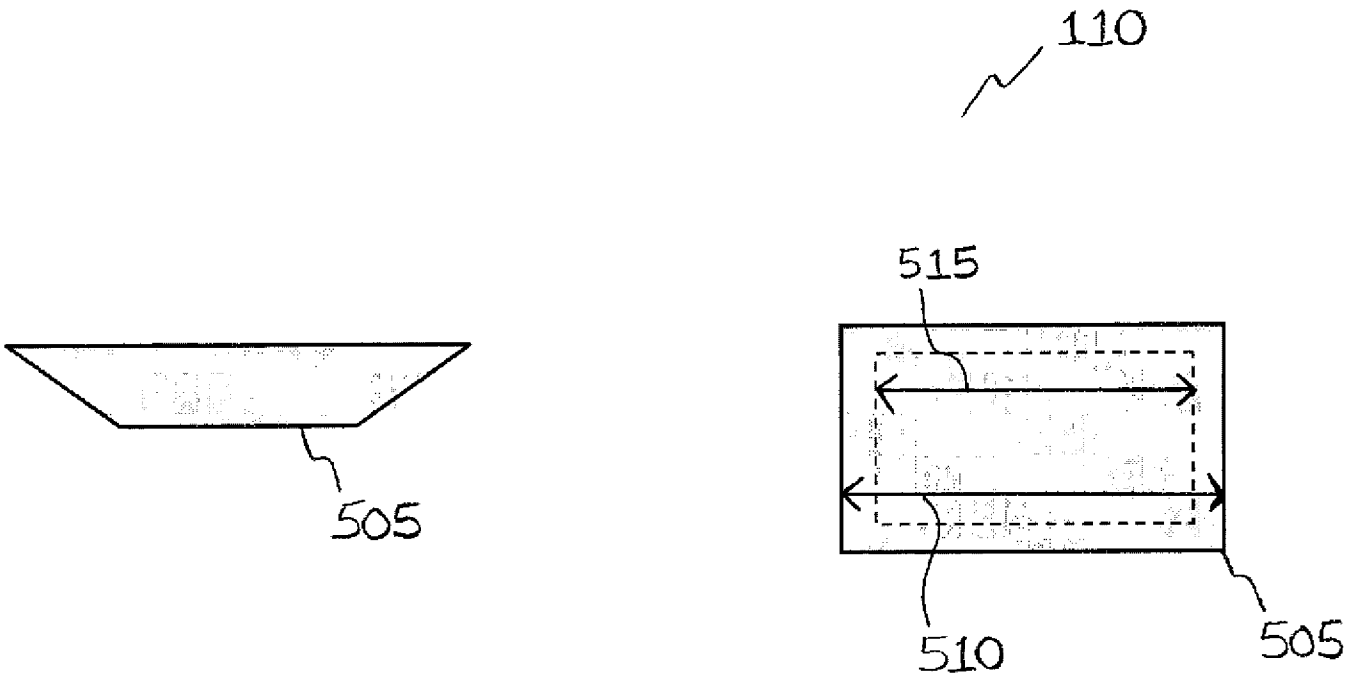

Referring to FIG. 5, in an exemplary embodiment of the present invention, the lift, cushion 110 may comprise a substantially inverted trapezoidal shape with tapers at end portions and edge portions 505. For example, the top of the lift cushion 110 may have a width 510 that may be wider than the width 515 of the bottom of the lift cushion 110. In one embodiment, the taper may slope inward from the top to the bottom of the lift cushion 110. However, it should be understood that the lift cushion 110 may comprise any suitable shape, such as a rectangle with blunt edges, for providing the desired lift height.

Referring to FIGS. 6A-F, in various representative exemplary embodiments of the present invention, the user may use the chest support 105 with one or more traditional bed pillows 405 (FIG. 6A). In one embodiment, as shown in FIG. 6B, the lift cushion 110 may be disposed under the traditional bed pillow 405 and the chest support 105 may be placed under the chest portion of the body to elevate the chest portion and relieve shoulder pressure from the surface 120. In another embodiment, as shown in FIG. 6C, the lift cushion 110 may additionally be disposed under the chest support 105 to provide additional elevation to the chest, such as for a user with a body weight that significantly compresses the chest support 105 and may benefit from the additional elevation provided by the lift cushion 110.

In an exemplary embodiment of the present invention, shown in FIG. 6D, the combination of the chest support 105 and the lift cushion 110 comprise a sloped wedge shape for providing a substantially aligned spinal portion of the body, wherein two lift cushions 110 of various sizes may be disposed under the head portion of the body and may be configured to be higher relative to at least one of the chest support and the combined elevation provided by the lift cushion disposed under the chest support. In another embodiment, the combined elevation provided by the lift cushion 110 disposed under the chest support 105 is configured to be higher relative to the lift cushion 110 disposed under the hip portion of the body forming a sloped wedge shape for alignment of a spinal portion of the body (not shown).

In one embodiment, according to various aspects of the present invention, and shown in FIGS. 6E and 6F, an elongated lift cushion 110 may be disposed under one or more traditional bed pillows 405 and extend under the chest support 105, forming a sloped wedge shape. The user's shoulder and arm may rest on the top of the elongated lift cushion 110, in the valley created between the traditional bed pillow 405 and the chest support 105. In a further embodiment, the elongated lift cushion 110 may extend slightly beyond the chest support 105 toward the hip portion of the body to provide a graduated and tapered transition from the chest portion to the hip portion of the body, maintaining the sloped wedge shape of the body support system 100.

The body support system 100 may comprise various dimensions to accommodate the needs of the user such as, for example, the user's height, weight, and firmness preferences. Table I comprises representative illustrations of exemplary embodiments of the dimensions of the present invention as a function of the user's frame height, body weight, and the firmness of the sleep surface.

TABLE I

| Sleeper Size | Sleep Surface: Hard (hard surface or very firm mattress) | Medium (medium-soft to firm mattress) | Soft (soft, flexible, contour mattress) |
|---|---|---|---|
| Small (<5' tall, <110 lbs) | Medium (9" × 18" × 2") | Small 7" × 16" × 1" | Small 7" × 16" × 1" |
| Average (5' to 5'8" tall, 110-160 lbs) | Large (11" × 18" × 3") | Medium (9" × 18" × 2") | Medium (9" × 18" × 2") |
| Large (>5'8" tall, >160 lbs) | Large (11" × 18" × 3") | Large (11" × 18" × 3") | Medium (9" × 18" × 2") |

The body support system 100 may be customized according to any dimension or feature to meet the need of a user and/or group of users. For example, the body support system 100 may comprise a higher firmness to accommodate users with heavy body weights and/or, a lower firmness for the comfort of users with lighter body weights. In one embodiment, the width of the chest support 105 may extend through the first seven ribs to allow the user to breathe deeply during sleep without interference. In one aspect of the embodiment, the width of the chest support 105 may extend between the user's collarbone or armpit and the elevation of the distal most tip of the xiphoid process of the user's sternum.

In some embodiments, the thickness of the chest support 105 may be determined by evaluating factors such as, for example, the user's weight, shoulder size, and diameter of the upper arm. The load bearing resistance of the chest support 105 may be varied using any suitable material, density, and/or change in dimensions to achieve the desired resistance. For example, for users with a heavy bodyweight, the weight bearing cross-section may be increased by increasing the width of the chest support 105. The nominal maximum width of the chest support 105 may vary with the user's size and weight. In one aspect of the embodiment, the thickness of the chest support 105 may comprise the distance from the user's shoulder exterior to their torso when the user is lying on their side, such as, for example ¾ of an inch.

The body support system 100 comprising at least one of the chest support 105 and the lift cushion 110 may be constructed from any suitable component material known to one skilled in the art either now existing or hereinafter produced, developed, or implemented in the future. In various embodiments, the chest support 105 and the lift cushion 110 may each be one piece and/or of layered construction. In some embodiments, each of the chest support 105 and the lift cushion 110 may be integrated and/or connected to one or more of each other. In one embodiment, the chest support 105 and the lift cushion 110 may be configured to be easily removable to allow the user to change from sleeping on their side, with the chest support 105, to sleeping on their back, without the chest support 105.

The component material may be provided in any suitable physical form such as, for example, liquids, capsules, gels, gases, foam, and/or solids. In various embodiments of the present invention, the component material may be washable, cleanable, soft, firm, biodegradable, hypoallergenic, moisture wicking, and/or disposable. In some embodiments, the component material may comprise foam such as, for example, memory foam and/or polyamidoester foams such as polyisocyante, polycarbonate, and/or polyurethane. In one embodiment, the component material may comprise particulates such as, for example, buckwheat hull, beans, plastic particles such as small tubes, and/or foam pieces. In another embodiment, the component material may comprise polyamidoester battings, rubber, non-slip materials, bed bug proof materials, synthetic fibers, Dacron, and/or natural fibers such as wool, cotton, and/or flax. The component material may also comprise air and/or a discrete gas such as nitrogen in an inflatable support.

The component material of the body support system 100 may be determined by specific needs of the user. For example, an inexpensive, disposable component material may be used for hospital and/or nursing applications requiring increased vigilance for hygiene. However, the component material may comprise a more expensive, washable, and/or durable material where the user desires prolonged use of the body support system 100.

The component material may be formed into the chest support 105 and the lift cushion 110 by any suitable manufacturing method known to one skilled in the art either now existing or hereinafter produced, developed, or implemented in the future. For example the chest support 105 and the lift cushion 110 may be carved from a single and/or multiple thickness component material, injection molding into a mold having the proper shape, and/or curing of the component material. In one embodiment, the surface of the chest support 105 and the lift cushion 110 may be smooth and/or corrugated with "egg carton" type depressions according to the user's desire.

Figure 7:
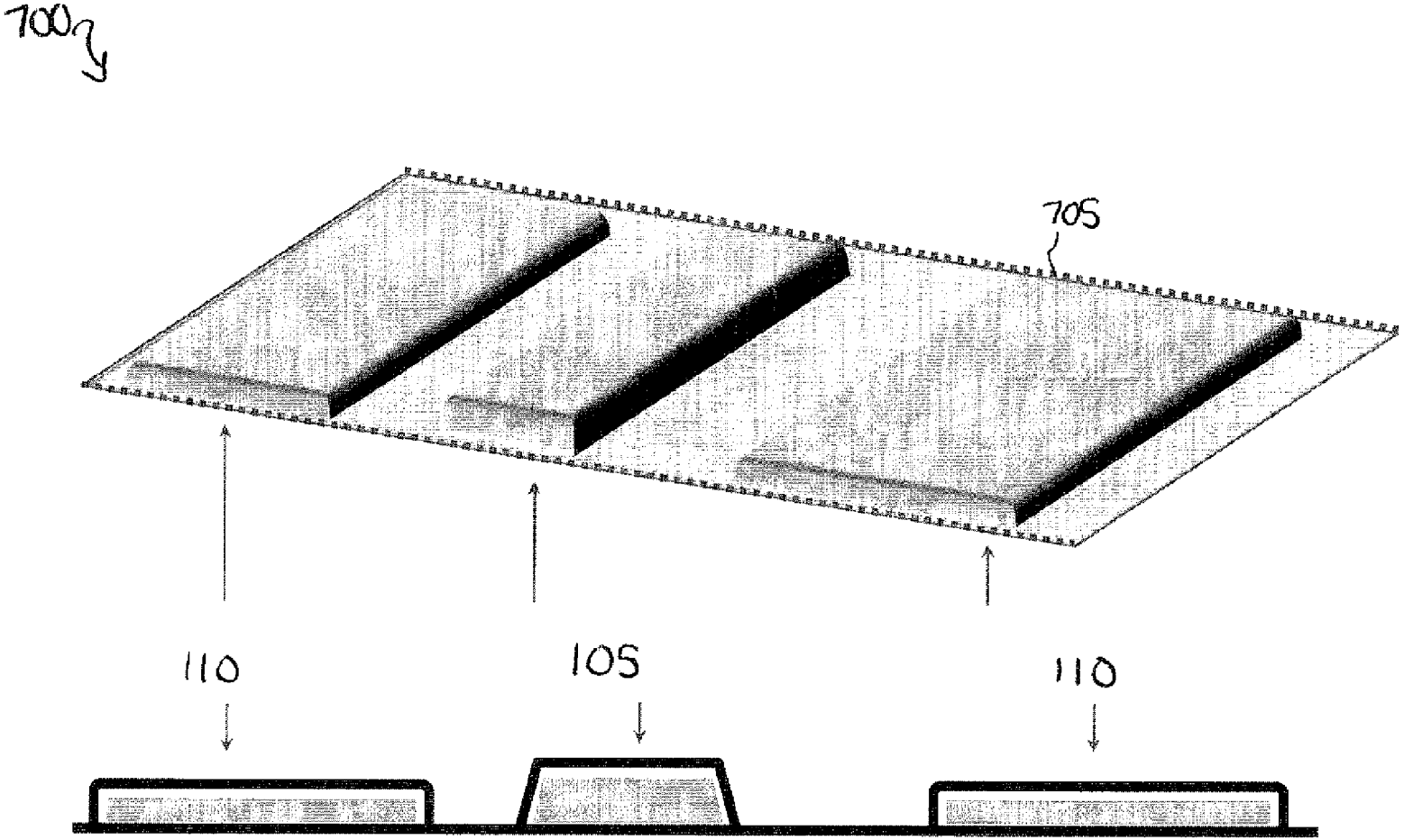
FIG. 7 representatively illustrates an exemplary body support system housing of the present invention.

Referring to FIG. 7, the body support system 100 may comprise a body support system housing 700 such as, for example, a skin coupled to the component material, a slipcover, and/or a pillowcase. The body support system housing 700 may enclose at least one of the chest support 105 and the lift cushion 110. In an exemplary embodiment of the present invention, the body support system housing 700 may comprise a single piece configured to enclose the chest support 105 and any number of lift cushions 110 in a substantially wedge shape (not shown). In various embodiments of the present invention, the body support system housing 700 may be washable, cleanable, soft, firm, biodegradable, hypoallergenic, moisture wicking, and/or disposable. In some embodiments, the body support system housing 700 may comprise synthetic sheet materials, bed bug proof materials, either porous or nonporous, textiles such as cotton, wool, linen, muslin, polyester, polypropylene, nylon, sheepskin, leather, animal skins, an anti-slip material and/or coating, and/or natural or synthetic animal furs.

Figure 8:
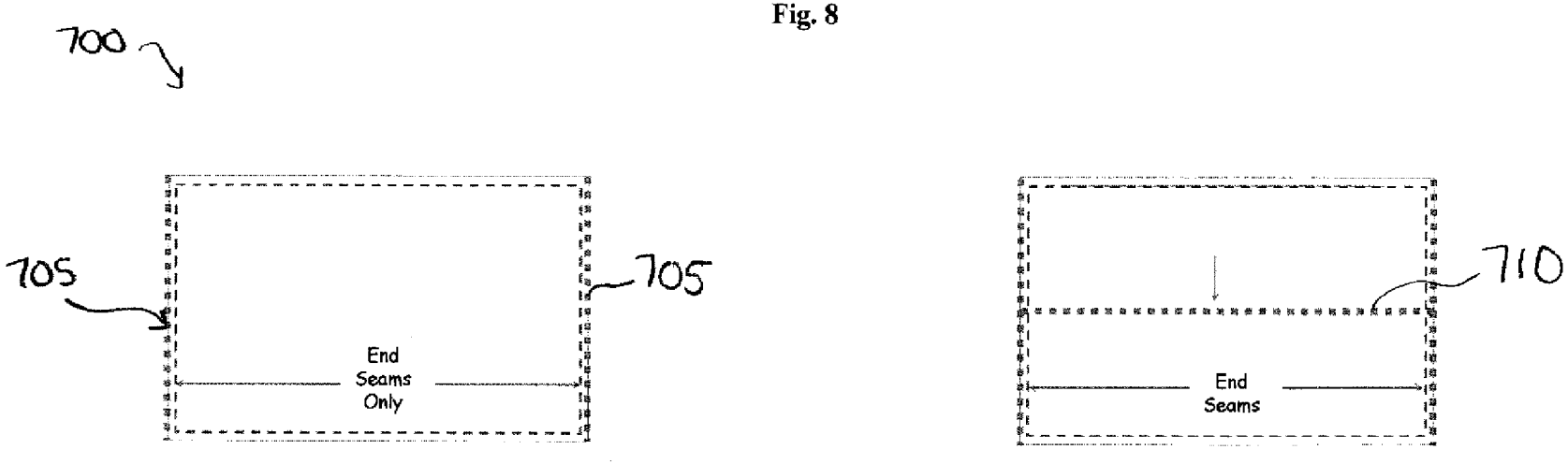
FIG. 8 representatively illustrates placement of seams in an exemplary outer covering of the present invention.

Referring to FIG. 8, the body support system housing 700 may comprise a seam, such as a longitudinal seam 710, positioned on the underside of the body support system 100 and an end seam 705 on each end. The longitudinal seam 710 may be configured not to contact the joint, such as the shoulder or hip joint which may result in irritation to the user, and may provide directional orientation of the body support system housing 700 over the chest support 105. The body support system housing 700 may be secured to one or more of the chest support 110 and the lift cushion 105 by zippers, laces, buttons, fastening devices used in the furrier and textile arts, and/or loop-pad or hook-patch fastener strips such as, for example, those sold under the trademark Velcro®.

Figure 9:
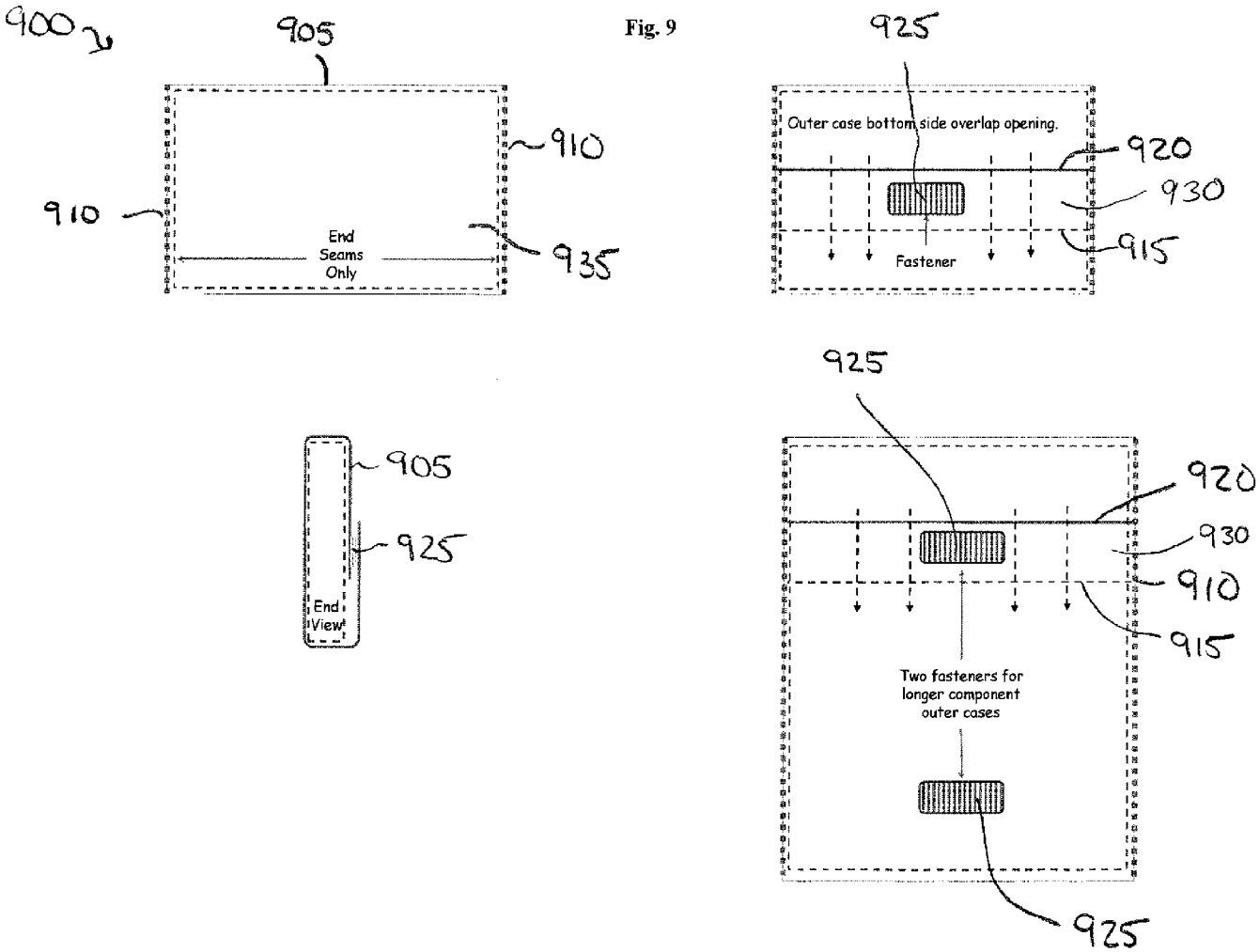
FIG. 9 representatively illustrates an exemplary outer covering of the present invention comprising an overlapping bottom portion.

Referring to FIG. 9, the chest support 105 and/or the lift cushion 110 of the body support system 100 may be separately enclosed by an outer covering 905. The outer covering 905 may comprise any covering or wrap suitably configured to enclose at least one of the chest support 105 and/or the lift cushion 110, such as a pillow case, a sealed bag, a pouch, and a European style pillow case. In one embodiment, the outer covering 905 may comprise an end seam 910 placed away from contact with the user, such as on side edges or the bottom side of the outer covering 905, facing the surface 120. Placing the end seam 910 away from the user may provide comfort to the user by eliminating pressure on the shoulder, head, neck, torso, and/or the hip from contact with the end seam 910.

In another embodiment, the outer covering 905 may comprise an opening 930 for inserting at least one of the chest support 105 and the lift cushion 110. In an exemplary embodiment of the present invention, the outer covering 905 may comprise a top portion 935 coupled to a first bottom portion 920 and a second bottom portion 915, wherein the first bottom portion 920 overlaps over the second bottom portion 915 to provide an opening 930 to receive at least one of the chest support 105 and the lift cushion 110. In one embodiment, the top portion 935, the first bottom portion 920, and the second bottom portion 915 may comprise three or more pieces of any suitable material, such as fabric, sewn together with the end seams 910. For example, the top portion 935 may comprise one piece of material, the first bottom portion 920 may comprise a second piece of material, and the second bottom portion 915 may comprise a third piece of material. In another embodiment, the top portion 935, the first bottom portion 920, and the second bottom portion 915 may comprise a continuous piece of fabric that wraps around at least one of the chest support 105 and the lift cushion 110. In one embodiment, the outer covering 905 may enclose at least one of the chest support 105 and the lift cushion 110 and another chest support 105 or lift cushion 110 may be partially inserted into the overlap section.

In a representative exemplary embodiment of the present invention, the outer covering 905 may comprise at least one fastener 925 for coupling two or more outer coverings 905 together either directly or indirectly with an outer covering connector pouch 1000, as described below relating to FIG. 10. For example, the fastener 925 may couple two outer coverings 905, each enclosing at least one of the chest support 105 and the lift cushion 110, stacked on top of one another. In one embodiment, the fastener 925 may be coupled to at least one of a wrong side of the first bottom portion 920 and a right side of the second bottom portion 915, wherein a wrong side may be the side of the material facing an inner portion of the outer covering 905 and the right side may be the side of the material facing an outer portion the outer covering 905. The fastener 925 may comprise any suitable device for coupling two outer coverings 905, such as zippers, laces, buttons, loop-pad or hook-patch fastener strips such as those sold under the trademark Velcro®.

Figure 10:
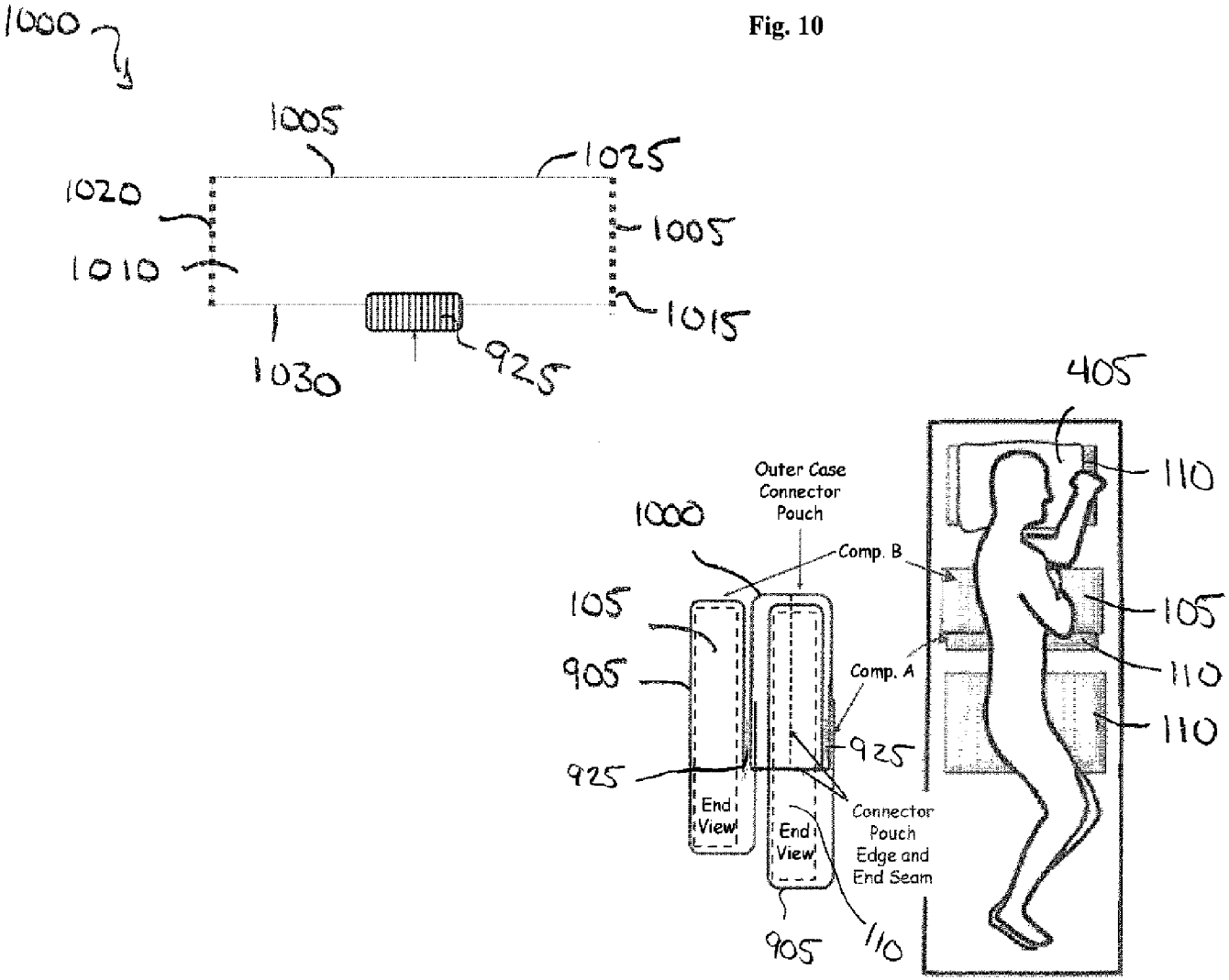
FIG. 10 representatively illustrates an exemplary outer covering connector pouch of the present invention.
Figure 11:
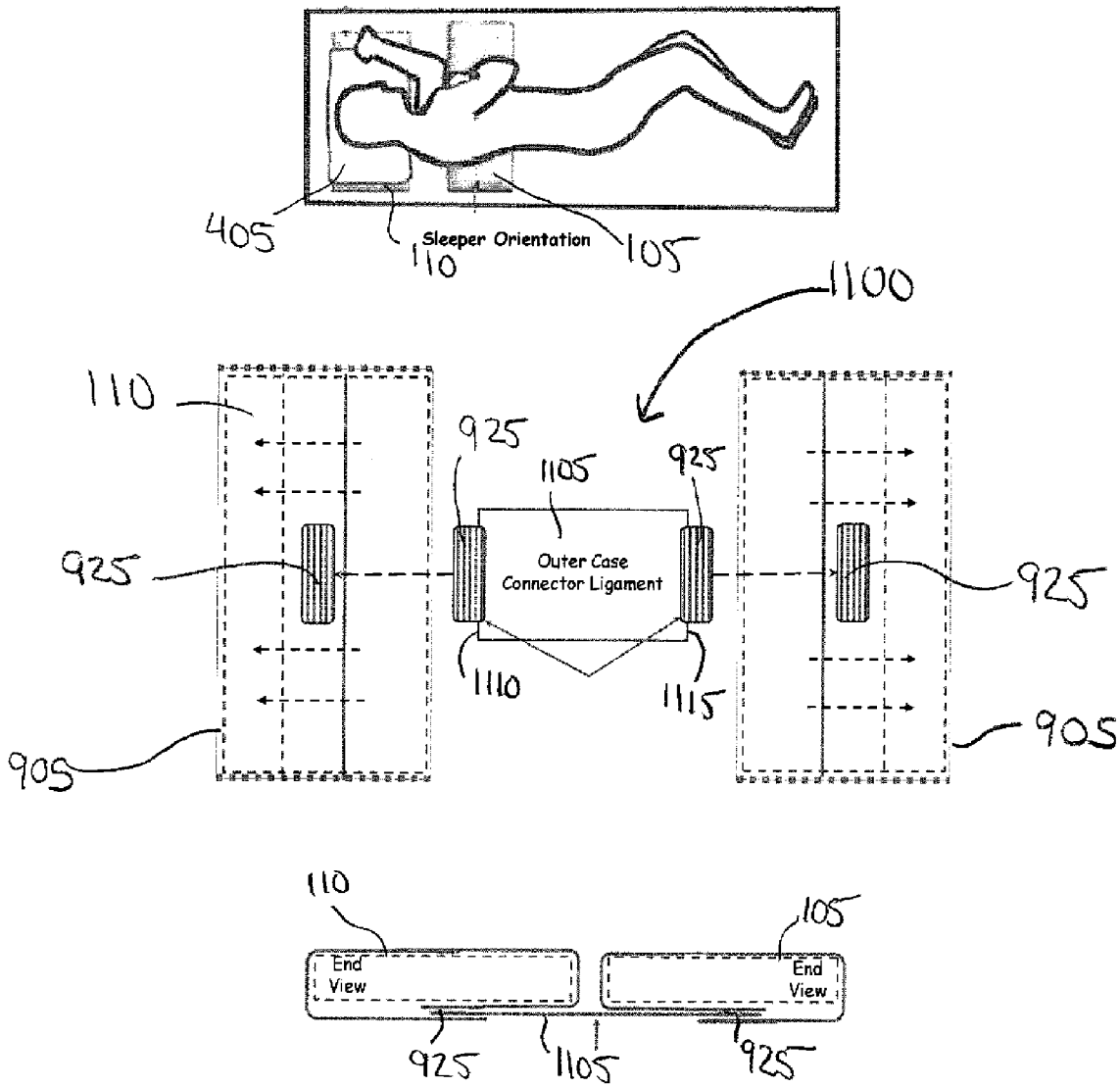
FIG. 11 representatively illustrates an exemplary inter-support connector of the present invention.

Referring to FIG. 10, in various aspects of the present invention, the fastener 925 may be adapted to connect to a matching fastener 925 on an outer covering connector pouch 1000. In an exemplary embodiment, two stacked outer coverings 905 that may each enclose at least one of the chest support 105 and the lift cushion 110 may be connected with the outer covering connector pouch 1000 that may partially encase the bottom outer covering 905. In one embodiment, the outer covering connector pouch 1000 may comprise three sealed ends and an open end, with two fasteners 925 coupled to each of the top portion 1010 and the bottom portion 1015 of a fourth open end. The outer covering connector pouch 1000 may couple to the underside of a top or stacked outer covering 905 containing at least one of the chest support 105 and the lift cushion 110, wrap around and partially encase the bottom outer covering 905, and couple to the underside of the bottom outer covering 905.

In an exemplary embodiment of present invention, the outer covering connector pouch 1000 may comprise a first side portion 1005 coupled to a first edge of a top portion 1010 and a first edge of a bottom portion 1015; a second side portion 1020 coupled to a second edge of the top portion 1010 and a second edge of the bottom portion 1015; a third side portion 1025 coupled to a third edge of the top portion 1010 and a third edge of the bottom portion 1015, with any suitable method such as sewing, bonding, and/or a fastener such as button or zipper. The matching fastener 925 may be coupled to a fourth edge 1030 of the top portion 1010 for connecting to the fastener 925 on an outer covering 905 and another matching second fastener 925 may be coupled to a fourth edge 1030 of the bottom portion 1015 for connecting to the fastener 925 on a second outer covering 905 stacked below the first outer covering 905. In this manner, any number of outer coverings 905 containing at least one of a chest support 105 and a lift cushion 110 may be stacking with their position fixed relative to one another.

In various aspects of the present invention, the fastener may be adapted to connect to a matching fastener on an inter-support connector 1100. The inter-support connector 1100 may comprise any suitable device for connecting two or more outer coverings 905. The outer coverings 905 may enclose at least one of the chest support 105 and the lift cushion 110 and may be configured to be adjacent to each other. For example, in an exemplary embodiment, the outer covering 905 may enclose the lift cushion 110 placed under the head portion of the body. The traditional bed pillow 405 may be placed over the lift cushion 110 that may be encased in the outer covering 905. The chest support 105 may be placed under the chest portion of the body. The inter-support connector 1100 may be configured to couple the outer covering 905 over the lift cushion 110 located adjacent to the outer covering 905 of the chest support 105 to substantially fix the position of the lift cushion 110 relative to the chest support 105.

In an exemplary embodiment of the present invention, the inter-support connector 1100 may comprise a ligament 1105 that may have the fastener 925 on the ends of the ligament 1105. In one embodiment, the ligament 1105 may couple to the matching fastener 925 on the underside of the two adjacent outer coverings 905. In one embodiment, the two adjacent outer coverings 905 coupled together with the inter-support connector 1100 may have a space between them, such as to provide additional room for shoulder placement. In another embodiment, the two adjacent outer coverings 905 coupled together with the inter-support connector 1100 may be directly adjacent such that there is no space between them.

In an exemplary embodiment of the present invention, the inter-support connector 1100 may comprise a predetermined length of ligament 1105 material that may correspond to the user's preference to have a space of a predetermined length or no space between adjacent outer coverings. The inter-support connector 1100 may further comprise the fastener 925 coupled to a first edge 1110 of the ligament 1105 for connecting to the fastener 925 on a first outer covering 905 and another fastener 925 coupled to a second edge 1115 of the ligament 1105 for connecting to the fastener 925 on another outer covering 905 located adjacent to the first outer covering 905.

In some embodiments, the body support system 100 may be decorated according to the user's specifications. In one embodiment, the body support system 100, outer covering 900, and/or the body support system housing 700 may comprise a printed design, a painted design, and/or decorative fixtures such as ribbon and/or lace. In various embodiments, the body support system 100 outer covering 900 and/or the body support system housing 700 may be decorated to be attractive for use by children.

Figure 12:
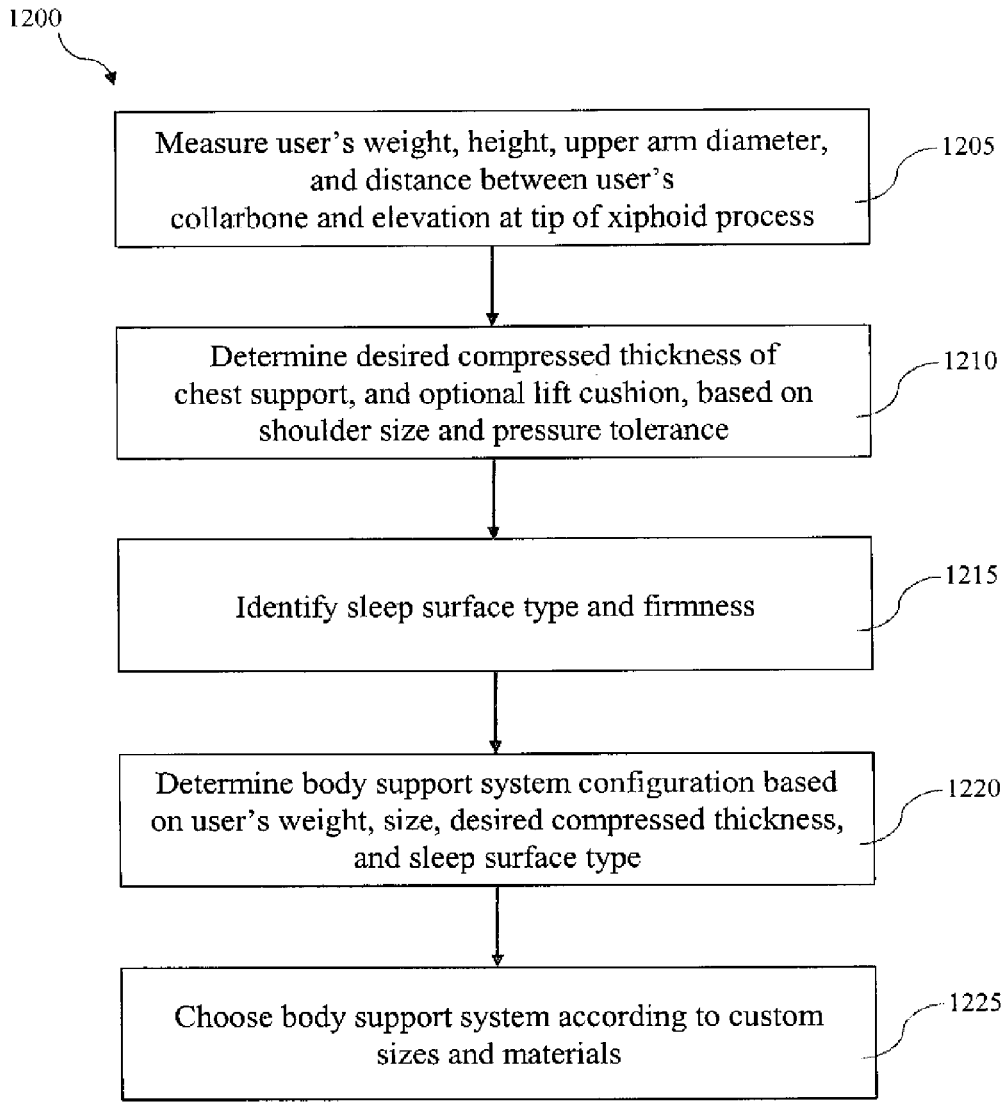
FIG. 12 is a flow chart illustrating an exemplary method of customizing a representative implementation of the present invention.

FIG. 12 illustrates an exemplary method of customizing a representative implementation of the present invention (1200). The method of customization may comprise measuring the user's weight, height, upper arm diameter, and the distance between a user's collarbone or armpit and the elevation of the distal tip of the user's xiphoid process to determine the optimal maximum width of a chest support, such as the chest support 105 (1205). Determining the user's tolerance of pressure on the shoulder and the user's shoulder size by the distance from the user's shoulder exterior to the torso when the user is lying on their side, may dictate the compressed thickness of the chest support (1210). The type sleep surface, such as surface 120, and firmness of the surface may also be determined (1215). The user may choose the desired body support system configuration based on the user's weight, size, desired compressed thickness, pressure tolerance, upper arm diameter, and sleep surface type (1220). For example, the user may choose one or more of the chest support and the lift cushion, such as the lift cushion 110, at any appropriate firmness which may be provided by their component material and/or number and dimensions of the layers in the component material. The user may then choose a body support system, such as the body support system 100, according to a range of sizes and features and/or according to customized construction of the body support system that may be adapted to the user's specifications (1225). However, a medical professional may make measurements and/or the decisions as to the implementation (1200). Furthermore, in various aspects of the present invention, various standard user sizes and weights may be used for implementation (1200) when standard sizes and weights are particularly useful for mass producing body support system 100 in standard sizes.

Figure 13:
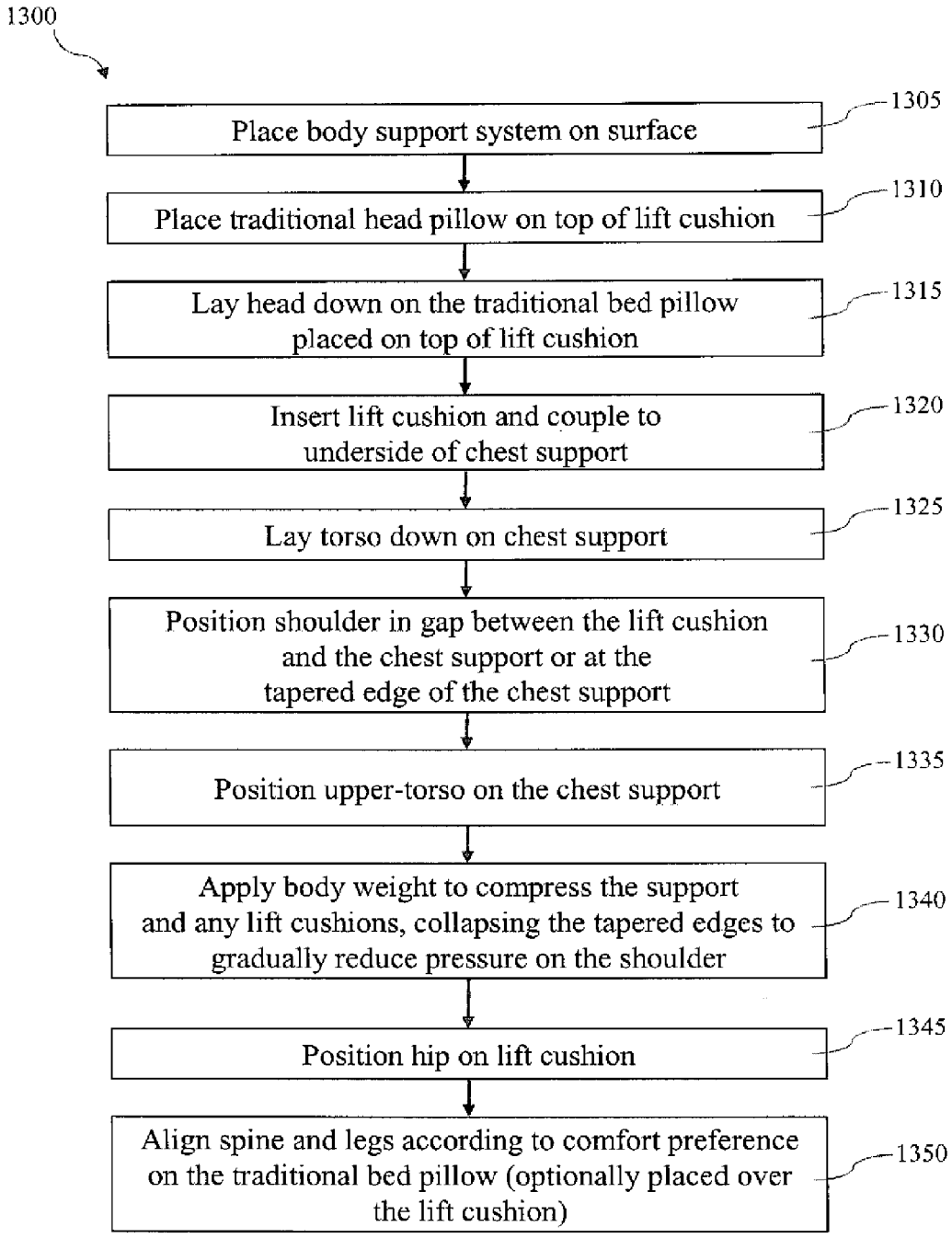
FIG. 13 is a flow chart illustrating an exemplary method of operating a representative implementation of the present invention.

FIG. 13 illustrates an exemplary method of operating a representative implementation of the present invention (130). A method of operating a body support system, such as the body support system 100, according to various aspects of the present invention, may comprise placing the body support system on a surface, such as the surface 120 (1305). A traditional bed pillow, such as the traditional bed pillow 405, may be placed on top of a lift cushion 110, such as the lift cushion 110 (1310). The user may lay their head down onto the traditional bed pillow that was placed on top of the lift cushion (1315). The lift cushion may be coupled to the underside of a chest support, such as the chest support 105, for added elevation of the chest support (1320). The user may rest their torso onto the chest support (1325). The torso may be positioned on the chest support such that the primary weight of the torso is applied to the central portion of the chest support, allowing the user's shoulder to occupy the gap created by the chest support and the lift cushion or at the tapered edge of the chest support, or the torso may be applied toward the edge taper or at an angle for optimal comfort and less lift height if desired (1330, 1335). The user's body weight may compress the chest support and any lift cushions to collapse the tapered edges into their intended shape to reduce pressure on the shoulder while continuing to the support the chest (1340). The user may further place their hip to knee area on the lift cushion, such as a separate lift cushion 110, to accommodate the increased height of the chest and the head resulting from use of the chest support and any lift cushion (1345). The user may then adjust their body position on the body support system, such as the body support system 100, to align their spine and/or legs according to comfort (1350).

In the foregoing description, the invention has been described with reference to specific exemplary embodiments. Various modifications and changes may be made, however, without departing from the scope of the present invention as set forth. The description and figures are to be regarded in an illustrative manner, rather than a restrictive one and all such modifications are intended to be included within the scope of the present invention. Accordingly, the scope of the invention should be determined by the generic embodiments described and their legal equivalents rather than by merely the specific examples described above. For example, the steps recited in any method or process embodiment may be executed in any appropriate order and are not limited to the explicit order presented in the specific examples. Additionally, the components and/or elements recited in any system embodiment may, be combined in a variety of permutations to produce substantially the same result as the present invention and are accordingly not limited to the specific configuration recited in the specific examples.

Benefits, other advantages and solutions to problems have been described above with regard to particular embodiments. Any benefit, advantage, solution to problems or any element that may cause any particular benefit, advantage or solution to occur or to become more pronounced, however, is not to be construed as a critical, required or essential feature or component.

The terms "comprises", "comprising", or any variation thereof, are intended to reference a non-exclusive inclusion, such that a process, method, article, composition, system, or apparatus that comprises a list of elements does not include only those elements recited, but may also include other elements not expressly listed or inherent to such process, method, article, composition, system, or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

The present invention has been described, above with reference to an exemplary embodiment. However, changes and modifications may be made to the exemplary embodiment without departing from the scope of the present invention. These and other changes or modifications are intended to be included within the scope of the present invention.

The invention claimed is:

1. A body support system for relieving contact pressure on a joint in a body, comprising:

a chest support for elevating a chest portion of the body comprising:

a top portion;

a bottom portion coupled a predetermined distance from the top portion;

a first end portion coupled between a first edge of the top and bottom portions, wherein the first end portion forms a taper disposed between the top portion and the bottom portion of the first edge;

a second end portion opposite the first end portion coupled between a second edge of the top portion and bottom portions, wherein the second end portion forms a taper disposed between the top portion and the bottom portion of the second edge; and wherein the top portion of the chest support is configured to assume a substantially inverted arc shape when compressed by the weight of the body;

at least one of the first edge portion and the second edge portion of the substantially inverted arc shape of the compressed chest support is occupied by the joint; and the chest support is adjustable for positioning substantially between a collarbone portion of the body and a xiphoid process portion of the body when the body is in a side rest position;

a lift cushion configured to be disposed under at least one of a head portion of the body, a hip portion of the body, and the chest support; and an outer covering configured to separately enclose the chest support and the lift cushion, wherein the outer covering comprises a fastener to fix the outer covering enclosing the chest support to the outer covering enclosing the lift cushion in a substantially stacked position, wherein the outer covering comprises:

a top portion coupled to a first bottom portion and a second bottom portion, wherein the first bottom portion overlaps over the second bottom portion to provide an opening to receive at least one of the chest support and the lift cushion;

a first fastener coupled to at least one of a wrong side of the first bottom portion and a right side of the second bottom portion; and wherein the first fastener is adapted to connect to a matching second fastener on at least one of an outer covering connector pouch and an inter-support connector, wherein two or more adjacent outer coverings are coupled with the inter-support connector comprising:

a predetermined length of ligament material;

the matching second fastener coupled to a first edge of the ligament material for connecting to the first fastener on a first outer covering; and the matching second fastener coupled to a second edge of the ligament material for connecting to the first fastener on a second outer covering located adjacent to the first outer covering.

2. The body support system of claim 1, wherein the taper disposed between the top portion and the bottom portion of the first edge and the taper disposed between the top portion and the bottom portion of the second edge is configured to slope inward from the top portion to the bottom portion, and wherein a face of the first edge and the second edge is a substantially irregular trapezoidal shape.

3. The body support system of claim 1, further composing:

a third end portion coupled between a third edge of the top portion and bottom portions, wherein the third end portion forms a taper configured to slope inward from the top portion to the bottom portion of the third edge;

a fourth end portion opposite the third end portion coupled between a fourth edge of the top portion and bottom portions, wherein the fourth end portion forms a taper configured to slope inward from the top portion to the bottom portion of the fourth edge; and wherein, a face of the third edge and the fourth edge is a substantially inverted trapezoidal shape.

4. The body support system of claim 1, wherein the chest support is formed by coupling two or more layers of component material, wherein the layers decrease in size from the top portion to the bottom portion of the chest support.

5. The body support system of claim 4, further comprising a substantially rectangular shaped layer configured to be disposed over and coupled to the top portion of the chest support to a provide load bearing support for the body.

6. The body support system of claim 1, wherein the lift cushion disposed under the head portion of the body is configured to be higher relative to at least one of the chest support and the combined elevation provided by the lift cushion disposed under the chest support, forming a sloped wedge shape for alignment of a spinal portion of the body.

7. The body support system of claim 1, wherein the combined elevation provided by the lift cushion disposed under the chest support is configured to be higher relative to the lift cushion disposed under the hip portion of the body forming a sloped wedge shape for alignment of a spinal portion of the body.

8. The body support system of claim 1, further comprising a connector configured to couple two or more of the adjacent chest support and the lift cushion for fixing a predetermined adjacent position of the chest support and the lift cushion relative to each other.

9. The body support system of claim 1, wherein the outer covering connector pouch comprises:

a first side portion coupled to a first edge of a top portion and a first edge of a bottom portion;

a second side portion coupled to a second edge of the top portion and a second edge of the bottom portion;

a third side portion coupled to a third edge of the top portion and a third edge of the bottom portion;

the matching second fastener coupled to a fourth edge of the top portion for connecting to the first fastener on a first outer covering; and the matching second fastener coupled to a fourth edge of the bottom portion for connecting to the first fastener on a second outer covering stacked below the first outer covering.

10. The body support system of claim 1, further comprising a body support system housing configured to enclose the chest support with at least one lift cushion in a substantially wedge shape.

11. The body support system of claim 10; wherein the body support system housing comprises a top portion coupled to a first bottom portion and a second bottom portion, wherein the first bottom portion and the second bottom portion is adapted to have a seam that does not contact the joint and provides directional orientation of the body support system housing over the chest support with at least one lift cushion.

12. The body support system of claim 1, wherein the component material comprises at least one of a liquid, capsule, gel, gas, foam, and solid, memory foam, a polyamidoester foam, polyisocyante, polycarbonate, polyurethane, buckwheat hull, beans, plastic particles, tubes, a polyamidoester batting, rubber, a non-slip material, a bed bug proof material, a synthetic fiber, Dacron, wool, cotton, flax, and compressed air comprising nitrogen.

13. A body support system for relieving contact pressure on a shoulder in the body, comprising:

a chest support for elevating a chest portion of the body, comprising:

a top portion;

a bottom portion coupled a predetermined distance from the top portion, wherein the bottom portion has a smaller width than the top portion;

a first end portion coupled between a first edge of the top and bottom portions and a second end portion opposite from the first end portion coupled between a second edge of the top and bottom portions, wherein the first end portion and the second end portion slope inward from the top portion to the bottom portion to form a substantially irregular trapezoidal shape;

a third end portion coupled between a third edge of the top and bottom portions and a fourth end portion opposite from the third end portion coupled between a fourth edge of the top and bottom portions, wherein the third end portion and the fourth end portion slope inward from the top portion to the bottom portion to form an inverted trapezoidal shape;

wherein the chest support is configured to assume a substantially inverted arc shape when compressed by the weight of the body;

wherein at least one of the first edge portion and the second edge portion of the substantially inverted arc shape of the compressed chest support is occupied by the shoulder; and wherein the position of the chest support is configured to be adjustable for positioning substantially between a collarbone portion and a xiphoid process portion when the body is in a side rest position to allow an unobstructed breathing motion in the body;

a lift cushion configured to be disposed under at least one of a head portion of the body, a hip portion of the body, and the chest support; and an outer covering configured to separately enclose at least one of the chest support and the lift cushion, wherein the outer covering comprises a fastener to fix the outer covering enclosing at least one of the chest support to the outer covering enclosing the lift cushion in a substantially stacked position, wherein the outer covering comprises:

a top portion coupled to a first bottom portion and a second bottom portion, wherein the first bottom portion overlaps over the second bottom portion to provide an opening to receive at least one of the chest support and the lift cushion;

a first fastener coupled to at least one of a wrong side of the first bottom portion and a right side of the second bottom portion; and wherein the first fastener is adapted to connect to a matching second fastener on at least one of an outer covering connector pouch and an inter-support connector, wherein two or more adjacent outer coverings are coupled with the inter-support connector comprising:

a predetermined length of ligament material;

the matching second fastener coupled to a first edge of the ligament material for connecting to the first fastener on a first outer covering; and the matching second fastener coupled to a second edge of the ligament material for connecting to the first fastener on a second outer covering located adjacent to the first outer covering.

14. The body support system of claim 13, wherein, the chest support is formed by coupling two or more layers of component material, wherein the layers decrease in size from the top portion to the bottom portion of the chest support.

15. The body support system of claim 13, further comprising a substantially rectangular shaped layer configured to be disposed over and coupled to the top portion of the chest support to a provide load bearing support for the body.

16. The body support system of claim 13, wherein the lift cushion disposed under the head portion of the body is configured to be higher relative to at least one of the chest support and the combined elevation provided by the lift cushion disposed under the chest support, forming a sloped wedge shape for alignment of a spinal portion of the body.

17. The body support system of claim 13, wherein the combined elevation provided by the lift cushion disposed under the chest support is configured to be higher relative to the lift cushion disposed under the hip portion of the body forming a sloped wedge shape for alignment of a spinal portion of the body.

18. The body support system of claim 13, further comprising a connector configured to couple two or more of the adjacent chest support and the lift cushion for fixing a predetermined adjacent position of the chest support and the lift cushion relative to each other.

19. The body support system of claim 13, wherein the outer covering connector pouch comprises:

a first side portion coupled to a first edge of a top portion and a first edge of a bottom portion;

a second side portion coupled to a second edge of the top portion and a second edge of the bottom portion;

a third side portion coupled to a third edge of the top portion and a third edge of the bottom portion;

the matching second fastener coupled to a fourth edge of the top portion for connecting to the first fastener on a first outer covering; and the matching second fastener coupled to a fourth edge of the bottom portion for connecting to the first fastener on a second outer covering stacked below the first outer covering.

20. The body support system of claim 13, further comprising a body support system housing configured to enclose the chest support with at least one lift cushion in a substantially wedge shape.

21. The body support system of claim 20, wherein the body support system housing comprises a top portion coupled to a first bottom portion and a second bottom portion, wherein the first bottom portion and the second bottom portion is adapted to have a seam that does not contact the joint and provides directional orientation of the body support system housing over the chest support and at least one lift cushion.

22. The body support system of claim 13, wherein the component material comprises at least one of a liquid, capsule, gel, gas, foam, and solid, memory foam, a polyamidoester foam, polyisocyante, polycarbonate, polyurethane, buckwheat hull, beans, plastic particles, tubes, a polyamidoester batting, rubber, a non-slip material, a bed bug proof material, a synthetic fiber, Dacron, wool, cotton, flax, and compressed air comprising nitrogen.

23. A body support system for supporting a user on a support surface, said body support comprising a cushion including:

a bottom surface for placing on the support surface, where said bottom surface is substantially planar and has a bottom edge;

a top surface for accepting the body of the user, where said top surface is substantially planar top and has a top edge, and is substantially parallel to said bottom surface;

where a first cross-section of the cushion is perpendicular to said top surface and said bottom surface, and includes a first top edge and a first bottom edge, where a second cross-section of the cushion is perpendicular to said top surface, said bottom surface, and said first cross-section, and includes a second top edge and a second bottom edge, where said first top edge is longer than said first bottom edge, such that, when the support surface is planar, and when said bottom surface is placed on the support surface, the bottom edge contacts said support surface.

24. The body support of claim 23, where said second top edge is shorter than said second bottom edge.

25. The body support system of claim 24, where said first top edge has a first top edge first end and a first top edge second end, where said first bottom edge has a first bottom edge first end and a first bottom edge second end, where said first top edge first end extends beyond said first bottom edge first end, and where said first top edge second end extends beyond said first bottom edge second end.

26. The body support system of claim 24, where said second top edge has a second top edge first end and a second top edge second end, where said second bottom edge has a second bottom edge first end and a second bottom edge second end, where said second bottom edge first end extends beyond said second top edge first end, and where said second bottom edge second end extends beyond said second top edge second end.

27. The body support of claim 23, where said second top edge is equal to or longer than said second bottom edge.

28. The body support system of claim 23, wherein said cushion is constructed from one or more materials.

29. The body support system of claim 28, wherein the cushion includes two or more layers of material coupled together, wherein the layers decrease in size from said top surface to said bottom surface.

30. The body support system of claim 29, wherein the material comprises at least one of a liquid, capsule, gel, gas, foam, and solid, memory foam, a polyamidoester foam, polyisocyante, polycarbonate, polyurethane, buckwheat hull, beans, plastic particles, tubes, a polyamidoester batting, rubber, a non-slip material, a bed bug proof material, a synthetic fiber, Dacron, wool, cotton, flax, and compressed air comprising nitrogen.

31. The body support system of claim 23, said cushion further comprising two or more stacked cushions including an upper cushion and a lower cushion.

32. The body support system of claim 31, wherein the area defined by the first perimeter of said upper cushion is smaller than the area defined by the first perimeter of said lower cushion.

33. The body support system of claim 32, where the perimeter includes a pair of side edges, and wherein said cushion does not have a seam on said top or side edges.

34. The body support system of claim 23, wherein said cushion is a first cushion, wherein said body support system further comprises a second cushion comprising one or more stacked cushions configured to be disposed under one or more of a head portion of the body, a hip portion of the body, or said first cushion.

35. The body support system of claim 34, wherein when the head of the user is supported by said second cushion and the chest of the user is supported by said second cushion or said first cushion having a second cushion disposed thereunder, the head has a higher elevation than said chest.

36. The body support system of claim 35, wherein the head of the user is also supported by a head pillow.

37. The body support system of claim 34, further comprising a connector configured to couple said first cushion and the second cushion at a predetermined separation distance.

38. The body support system of claim 34, further comprising an outer covering configured to separately enclose the first cushion and the second cushion, wherein the outer covering comprises a fastener to fix the outer covering enclosing the first cushion to the outer covering enclosing the second cushion in a substantially stacked position.

39. The body support system of claim 34, further comprising a first case having a first opening to accept said first cushion, where said first case includes a first set of matching fasteners to close said first opening;

a second case having a second opening to accept said second cushion, where said second case includes a second set of matching fasteners to close said second opening; and a connector element having a first connector portion comprising a third set of matching fasteners and a second connector portion comprising a fourth set of matching fasteners, such that said third set of matching fasteners may be inserted between said first set of matching fasteners to both close said first opening and attach said connector to said first case, and said fourth set of matching fasteners may be inserted between said second set of matching fasteners to both close said second opening and attach said connector to said second case.

40. The body support system of claim 39, where said connector includes a length of material separating said first portion and said second portion, and where said connector, when attached to said first case and said second case, determines a maximum separation of said first case and said second case on the support surface.

41. The body support system of claim 39, where said connector is a case having an opening with a first opening side including said first portion and a second opening side including said second portion, where said opening is adapted to accept and attach said first portion to one of said first case or said second case and to attach said second portion to the other of said first case or second case, such that the connector secures said first case and said second case in a stacked configuration.

* * * * *